US011598038B2

(12) United States Patent
Lampaert et al.

(10) Patent No.: US 11,598,038 B2
(45) Date of Patent: Mar. 7, 2023

(54) INDIVIDUAL NEEDLE CONTROL TUFTING MACHINE

(71) Applicant: Michel Van de Wiele NV, Kortrijk (BE)

(72) Inventors: Vincent Lampaert, Vichte (BE); Koen Callewaert, Tielt (BE); Frank Marijsse, Kortrijk (BE); Liesbeth Luyckx, Kortrijk (BE); Frank Shanley, Lancashire (GB)

(73) Assignee: VANDEWIELE NV, Marke (BE)

( * ) Notice: Subject to any disclaimer, the term of this patent is extended or adjusted under 35 U.S.C. 154(b) by 0 days.

(21) Appl. No.: 16/771,580

(22) PCT Filed: Dec. 5, 2018

(86) PCT No.: PCT/EP2018/083685
§ 371 (c)(1),
(2) Date: Jun. 10, 2020

(87) PCT Pub. No.: WO2019/115317
PCT Pub. Date: Jun. 20, 2019

(65) Prior Publication Data

US 2020/0299887 A1 Sep. 24, 2020

(30) Foreign Application Priority Data

Dec. 13, 2017 (GB) ..... 1720794

(51) Int. Cl.
*D05C 15/30* (2006.01)
*D05C 15/18* (2006.01)
(Continued)

(52) U.S. Cl.
CPC ..... *D05C 15/30* (2013.01); *D05C 15/18* (2013.01); *D05C 15/20* (2013.01); *D05C 15/34* (2013.01); *D10B 2503/04* (2013.01)

(58) Field of Classification Search
CPC ..... D05C 15/10; D05C 15/12; D05C 15/16; D05C 15/18; D05C 15/20; D05C 15/26; D05C 15/30; D05C 15/34
See application file for complete search history.

(56) References Cited

U.S. PATENT DOCUMENTS 4,244,309 A 1/1981 Spanel et al.
4,831,948 A 5/1989 Sigeki et al.
(Continued)

OTHER PUBLICATIONS

The Search Report prepared by the Intellectual Property Office of Great Britain dated Jun. 12, 2018 for priority patent application No. GB1720794.5; 4 pages.
(Continued)

*Primary Examiner* — Nathan E Durham
(74) *Attorney, Agent, or Firm* — Smith Gambrell & Russell LLP

(57) ABSTRACT

A tufting machine and method for operating a tufting machine operating a needle selection mechanism based on pattern data by selecting a needle with yarn required for the pattern such that the selected needle is driven by a needle bar through the backing medium, to form a tuft while a needle that is not required for the pattern is not selected by the needle selection mechanism. Yarn is fed via a yarn feed mechanism comprising a plurality of actively driven yarn drives each driving a respective yarn to a respective needle, the yarn drives being at a location between a yarn creel and the needle. The method being characterised by operating the yarn feed mechanism to deliver at least 70% of the yarn required for a tuft as the needle moves from top dead center to bottom dead center.

12 Claims, 7 Drawing Sheets

(51) Int. Cl.
*D05C 15/20* (2006.01)
*D05C 15/34* (2006.01)

(56) References Cited

U.S. PATENT DOCUMENTS

| | | | | |
|---|---|---|---|---|
| 5,461,996 | A * | 10/1995 | Kaju | D05C 15/26 112/475.19 |
| 6,263,811 | B1 | 7/2001 | Hamdy | |
| 2009/0101051 | A1 | 4/2009 | Christman, Jr. | |
| 2017/0204546 | A1 | 7/2017 | Padgett et al. | |

OTHER PUBLICATIONS

The International Search Report prepared by the European Patent Office as International Search Authority dated Feb. 2, 2019 for the parent PCT application, PCT/EP2018/083685; 4 pages.

* cited by examiner

INDIVIDUAL NEEDLE CONTROL TUFTING MACHINE

CROSS-REFERENCE TO RELATED APPLICATIONS

This is a National Phase application of PCT/EP2018/083685, filed Dec. 5, 2018, which claims priority to Great Britain national application 1720794.5, filed Dec. 13, 2017.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Field of the Invention

The present invention related to an individual needle control tufting machine, also named an individually controlled needle tufting machine or an ICN tufting machine.

Description of Related Art

An individual needle control tufting machine refers to a tufting machine with a needle bar supporting at least one row of needles. A needle selection mechanism is controlled by a controller based on pattern data such that an individual needle (or a group of needles) which is threaded with a yarn which is required for the pattern can be selected by the needle selection mechanism to be driven by the needle bar through the backing medium to form a tuft (or tufts) while a needle (or a group of needles) that is not required for the pattern is not selected by the needle selection mechanism and is not driven through the backing medium as the needle bar reciprocates. Such an approach is used on the ColorTec® machine, of the applicant. To date, this has generally only been implemented in a cut pile machine.

Such tufting machine provides other advantages over the traditional approach to tufting.

According to the traditional approach, there is no ability to select individual needles. Thus, all needles on the needle bar are reciprocated together as the needle bar reciprocates. This means that all the yarns on all needles are driven into the backing material. If a particular yarn formed in this way is not required at a stitch location, the yarn tension can be controlled in order to pull the yarn low such that it is not seen in the finished carpet or to pull the yarn completely out of the backing material. When used with a sliding needle bar (which slides laterally with respect to the direction of the feed of the backing material through the tufting machine) the machine is able to control the yarn which appears at a particular location by pulling low or removing all of the yarns which are not required at that location and reducing the tension in the yarn of the desired loop so that it is not pulled low or removed and is hence visible in the finished carpet. This approach which requires pulling back of yarns to control pile height is not used for cut pile carpet.

Individual needle control (ICN) is a term of art which distinguishes a machine with the ability to select needles for reciprocation from the traditional approach described above where all needles are reciprocated. Whilst this is generally done on an individual basis, it is possible to have a selection mechanism which will select a particular group of needles. In the subsequent description, it should be understood that, when reference is made to selecting a needle, the possibility of selecting a group of needles is also a possibility even when this is not specifically stated. For the sake of brevity, this will not be repeated subsequently at every point throughout the specification.

The ICN machine that the present invention is concerned with similarly uses a sliding needle bar. The sliding needle bar is moved laterally across the backing material. The sliding needle bar will undergo a number of reciprocations in the same or approximately the same position but the latching mechanism to latch the individual needle to the needle bar ensures that only when the needle of the required colour is in the desired location the needle will be latched to the needle bar such that it is reciprocated to form a tuft of the desired colour.

An example of an ICN machine is disclosed in GB2242914 and GB2385604. Such a machine is produced by the applicant under the ColorTec brand.

Because the needle is only reciprocated when the desired needle is in place, there is no need to pull back unwanted yarns so that the previously described yarn feed mechanism is not provided. Instead, the yarn feed system is a passive system in which each needle is associated with a yarn latch. This yarn latch is in the form of a spring loaded pawl around which the yarn passes before being fed to the eye of the needle. The spring loaded pawl is associated with the individual needle holder such that, when the needle holder is latched to the needle bar, the yarn latch is reciprocated together with the needle bar. Because the yarn is trapped by the spring loaded pawl, this pulls the yarn downwardly with the needle so that the yarn is drawn from the creel and is available to form the tuft.

A problem with such an arrangement is illustrated in FIGS. 1 to 3. FIG. 1 is schematic representation of the formation of a stitch with the ColorTec mechanism.

The needle stroke S represents the distance between top dead centercenter (TDC) and bottom dead centercenter (BDC). This stroke represents the sum of the top stroke TS (i.e. the maximum height of the needle 1 tip material above the backing cloth 2) and the pile height PH.

FIG. 1 shows one complete needle cycle from top dead centercenter (FIG. 1A) on a first stroke to top dead centercenter (FIG. 1 F) of the following stroke. All of the same components are designated with the same reference numerals throughout.

In particular, the needle 1 is provided with an eye 3 through which a yarn 4 is threaded. A yarn latch 5 in the form of a spring loaded pawl is provided at the top of the needle. This will be described in detail later, but for the present explanation, it is sufficient to know that the yarn latch 5 will grip the yarn 4 as the needle moves downwardly so that there is no relative movement between the latch 5 and the yarn 4 on the down stroke. However, the latch 5 will then release the yarn 4 such that the yarn 4 will slide through the latch 5 on the upstroke. The yarn 4 is fed directly from the creel with no intervening yarn control.

In order to further illustrate the relative movement of the yarn during the process, two fixed points on the yarn are identified as A and B with point A being above the latch 5 and point B being below the latch 5.

Beginning from FIG. 1A, with the needle at top dead center, the needle then moves down penetrating the backing 2 in the position shown in FIG. 1B before reaching bottom dead center in the position shown in FIG. 10. This forms a new loop 6 as shown in FIG. 10. As can be seen from the position of points A and B on the yarn 4, the yarn 4 does not move with respect of the latch 5 during the down stroke. As the needle 1 moves down, therefore, the yarn 4 slides back through the eye 3 as the needle 1 approaches the backing material 2 (i.e. FIG. 1A to FIG. 1 B) thereby creating an excess of yarn as shown at position 7 in FIG. 1 B. Subsequent movement of the needle 1 through the backing material then pulls this excess of yarn through the backing material 2 thereby forming the loop 6. Throughout the remainder of the down stroke, no yarn is drawn through the latch 5 as is apparent from the position of points A and B from FIGS. 1A to 1C.

The upstroke is then illustrated in FIGS. 1D to 1 F. On the upstroke, the latch 5 permits the yarn 4 to slide through the latch. As a result of this, yarn slides through the eye 3 leaving the yarn in place to form the loop 6 as is apparent from the position of points A and B in FIGS. 1D to 1 F. As the needle reaches top dead center in position 1 F, the next stroke then begins to form a further loop. Either during the above described process or between two needle strokes, the backing 2 is shifted to the left in the figures to allow this new loop to be formed next to the previous loop 6.

Problems arise in such a machine where there is a need to tuft a carpet with a particularly low or a particularly high pile. The low pile situation is shown in FIG. 2. This situation can arise when machine constraints mean that the top stroke cannot be reduced any further and it is desirable to produce a low pile carpet.

In FIG. 2, FIG. 2A to 2C corresponds to FIG. 1A to FIG. 10 while FIG. 2D corresponds to FIG. 1 E. During the initial portion of the down stroke, an excess of yarn is created which subsequently forms the loop. Because the top stroke has now increased, this generates an oversize loop 10 as shown in FIG. 2B. As a result of this, the tension in the yarn is too low to make a high quality tuft 11 (shown in FIGS. 2C and 2D). Also, some slack yarn will be present above the latch 5 because the needle does not consume all of the yarn already drawn from the creel through the latch during the down stroke. This can cause the formulation of a loose back stitch 12 on the subsequent stroke.

The opposite situation is represented in FIG. 3. Here, the pile height is increased with respect to the top stroke. Again, this can occur when forming unusually large pile heights where machine constraints prevent the top stroke from being correspondingly adjusted. FIGS. 3A to C corresponds to FIGS. 1A to C, while FIG. 3D corresponds to FIG. 1E.

This time, rather than too much yarn being pulled down on the down stroke of the needle, too little is now pulled through such that the buffer of yarn pulled through by the needle is consumed before bottom dead center. Rather than drawing the yarn from the buffer, the needle now tries to draw the yarn directly from the creel. This significantly increases the tension in the yarn with a result that the needle is deflected as shown in FIG. 3C. This causes undue stress on the needle and can cause split loops as the needle interferes with an adjacent loop.

U.S. Pat. No. 4,831,948 discloses an ICN machine without a latch for each needle, wherein the yarn is actively supplied to each needle.

The present invention is directed to providing an individual needle control machine and methods which improve on U.S. Pat. No. 4,831,948.

BRIEF SUMMARY OF THE INVENTION

According to the present invention there is provided a method for controlling a tufting machine according to claim 1.

In a conventional yarn feed mechanism, the yarn is fed at a constant rate throughout the needle stroke. The one exception to this is that additional yarn may be fed towards top dead center of the stroke in the case of a sliding needle bar to compensate for the fact that more yarn is drawn as the needle moves laterally across the backing material. This is referred to as backing stitch compensation.

With the present invention, however, at least 70% and more preferably at least 80% of the yarn required to form a tuft is fed as the needle moves from top dead center to bottom dead center. It should be noted here that the yarn being fed is the yarn required to form the tuft. Yarn is also fed as backing stitch compensation but this backing stitch compensation feed is to be excluded when determining the percentage of yarn fed in the first half of the cycle. This provides a benefit that the yarn remains more stretched during the entire stitch cycle and slack can be avoided. The yarn feed profile could also advantageously be used in conventional tufting in order to provide better control of the yarn feed.

Preferably the yarn is fed from the yarn drive to the needle without passing through a latch.

An example of a yarn feed mechanism useable with the present invention is known as the Myriad®. This comprises a bank of servo motors each controlling an individual end of yarn. As the servo motors are arranged in banks, the length of yarn from the yarn feed mechanism to the needle can vary. Further, conventionally the yarns are arranged to be driven by the servo motors at variable rates depending on whether or not the yarn is required to produce a tuft at a particular location.

As a result of this, the tufting machine is typically provided with a pair of puller rods. These are a pair of rods between the yarn feed mechanism and the needles through which all of the yarns pass. The rolls are arranged to lightly touch each of the yarns which has the effect of equalising the yarn tension across the tufting machine as the yarns are fed from different heights and at different rates.

According to the present invention, however, certain needles are not selected and therefore will not draw any yarn on a particular stroke. This contrasts with a conventional situation where yarn is always drawn and then, if relating to an unwanted tuft, is pulled back. As the puller rods are always being turned by the yarns from selected needles, this can damage the static yarns from unselected tufts. Therefore, preferably, the yarn is arranged to be fed from the yarn drive to the needle without passing through a pair of puller rods.

More preferably, the yarn is arranged to be fed directly from the yarn drive to the needle, without passing any tension regulating or tension influencing components. It may, however, pass through guiding elements. These are arranged to ensure that the yarn does not change direction or to provide a controlled change of direction but they do not provide a controlled change of tension.

In some circumstances, it may be necessary to operate the yarn feed drives in reverse. This creates a slack yarn upstream of the yarn feed devices. Preferably, therefore, a yarn compensation device is provided to take up slack upstream of each yarn device. The yarn compensation device preferably comprises a weight for each yarn which pulls each yarn down to absorb the slack.

BRIEF DESCRIPTION OF THE SEVERAL VIEWS OF THE DRAWINGS

An example of a tufting machine will now be described with reference to the accompanying drawings, in which:

FIGS. 10 and 11 are views similar to FIG. 7 to 9 showing variations in the yarn feed profile for the formation of a first stitch or where a needle has not been selected for some time.

DETAILED DESCRIPTION OF THE INVENTION

Figure 1:
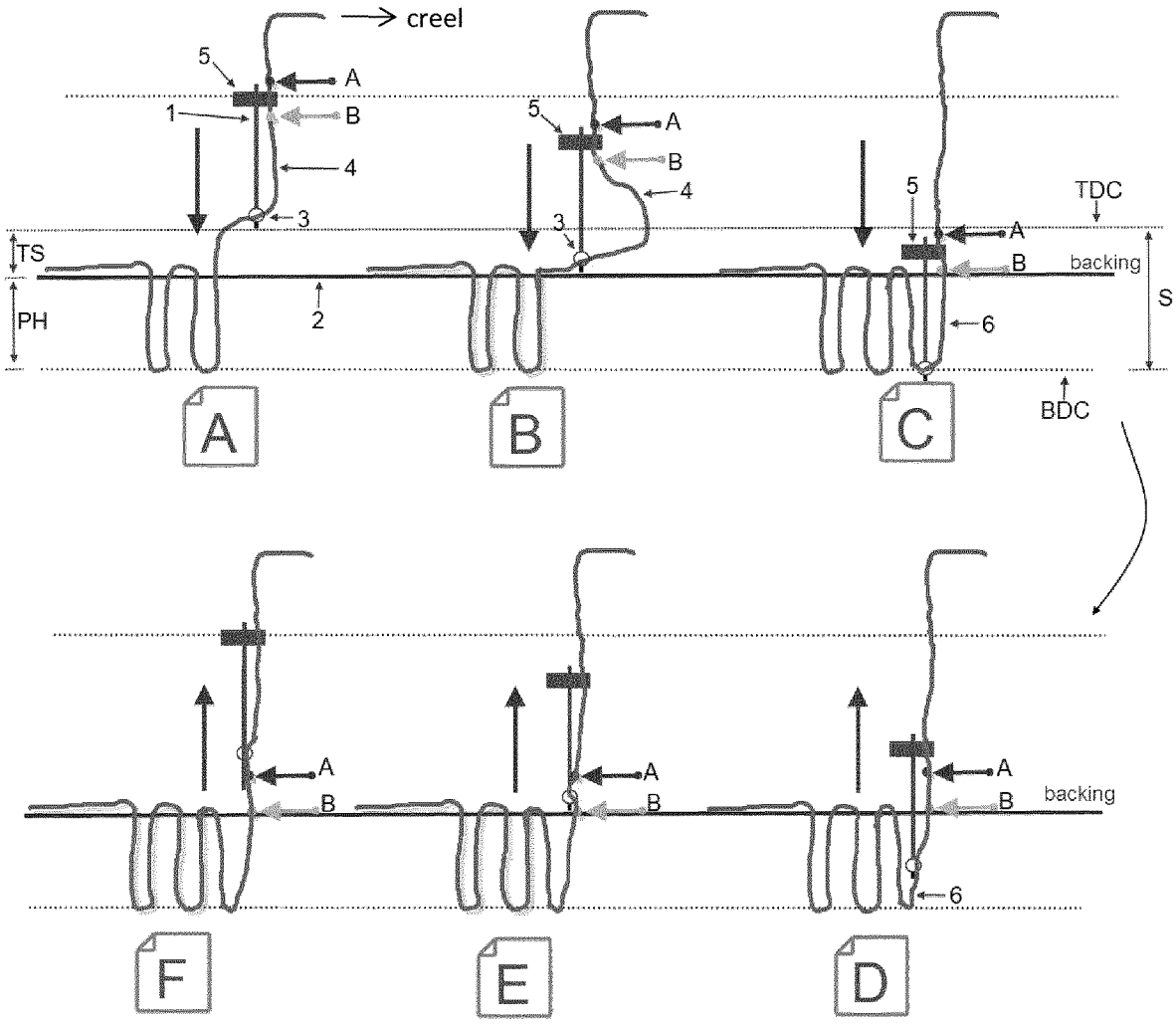
FIGS. 1A-F to 10 are schematic drawings showing the operation of an individual needle control tufting machine in the prior art.
Figure 2:
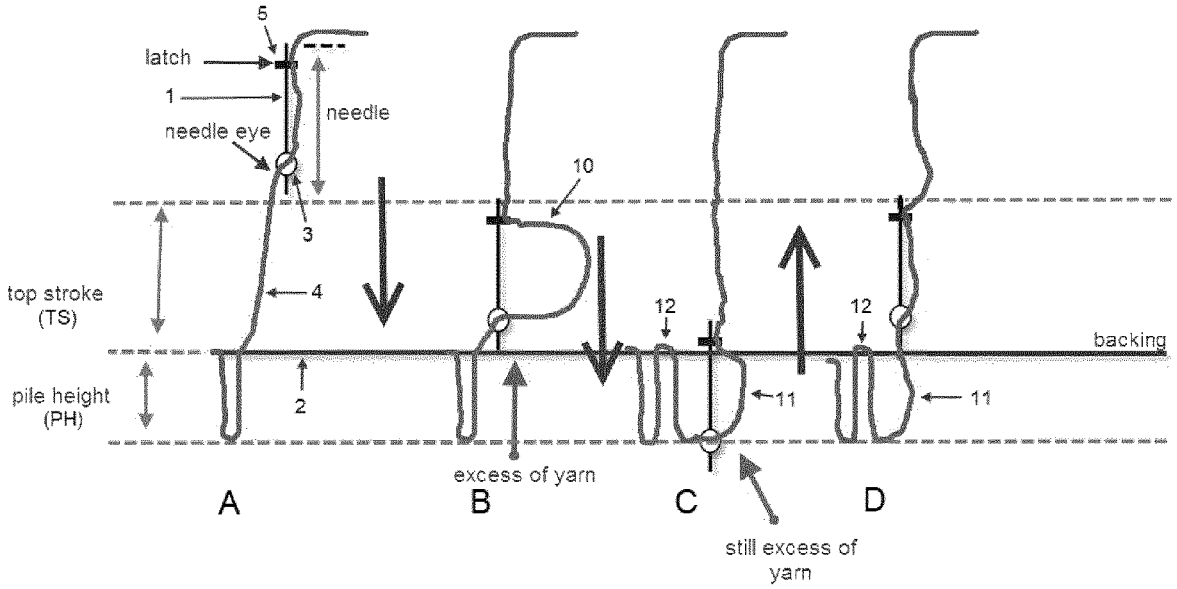
FIGS. 2A to D are similar representations showing the same operation with a low pile height.
Figure 3:
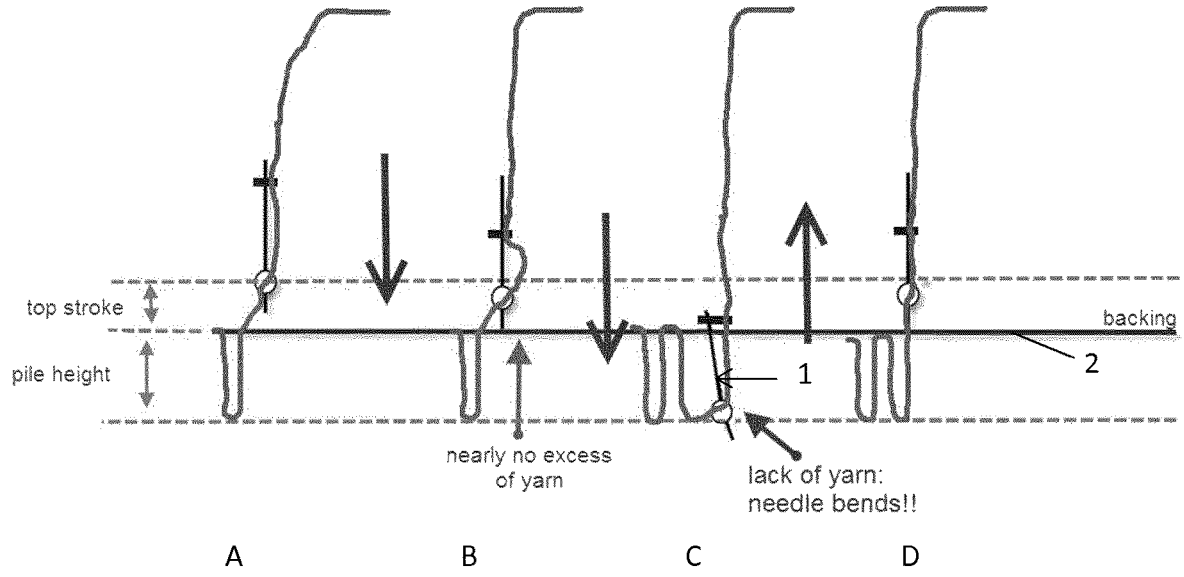
FIGS. 3A to D are similar representations showing the same operation with a high pile height.
Figure 4:
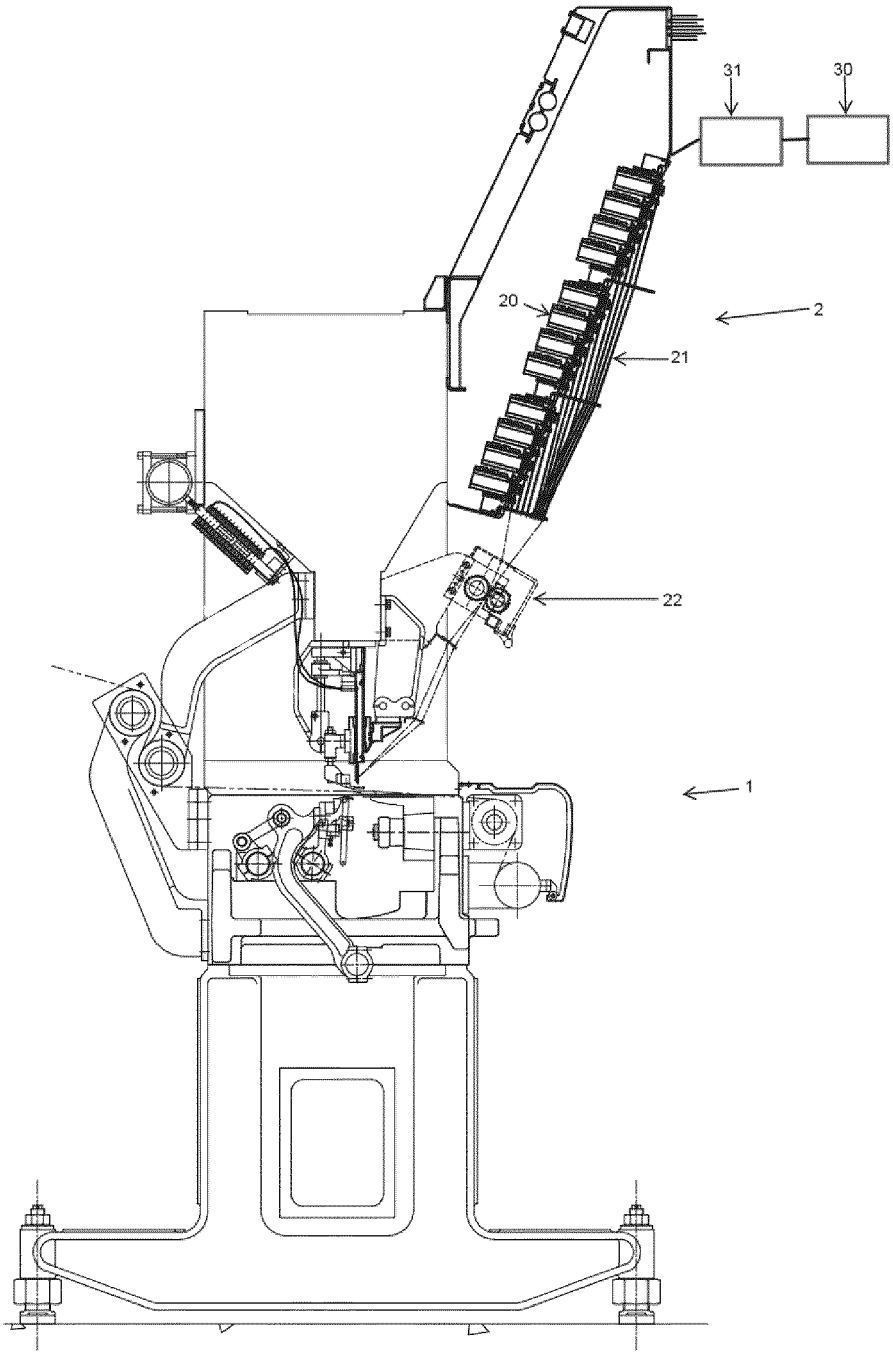
FIG. 4 is a schematic cross section of a tufting machine according to the present invention.

A tufting machine according to the present invention is shown in FIG. 4. For the purposes the description, this consists of two main components namely the main tufting machine 1 forming the bulk of the tufting machine and the yarn feed mechanism 2 to feed the yarn to the main tufting machine 1.

The tufting machine 1 is an individual needle control (ICN) machine as such as a ColorTec machine modified as set out below.

Figure 5:
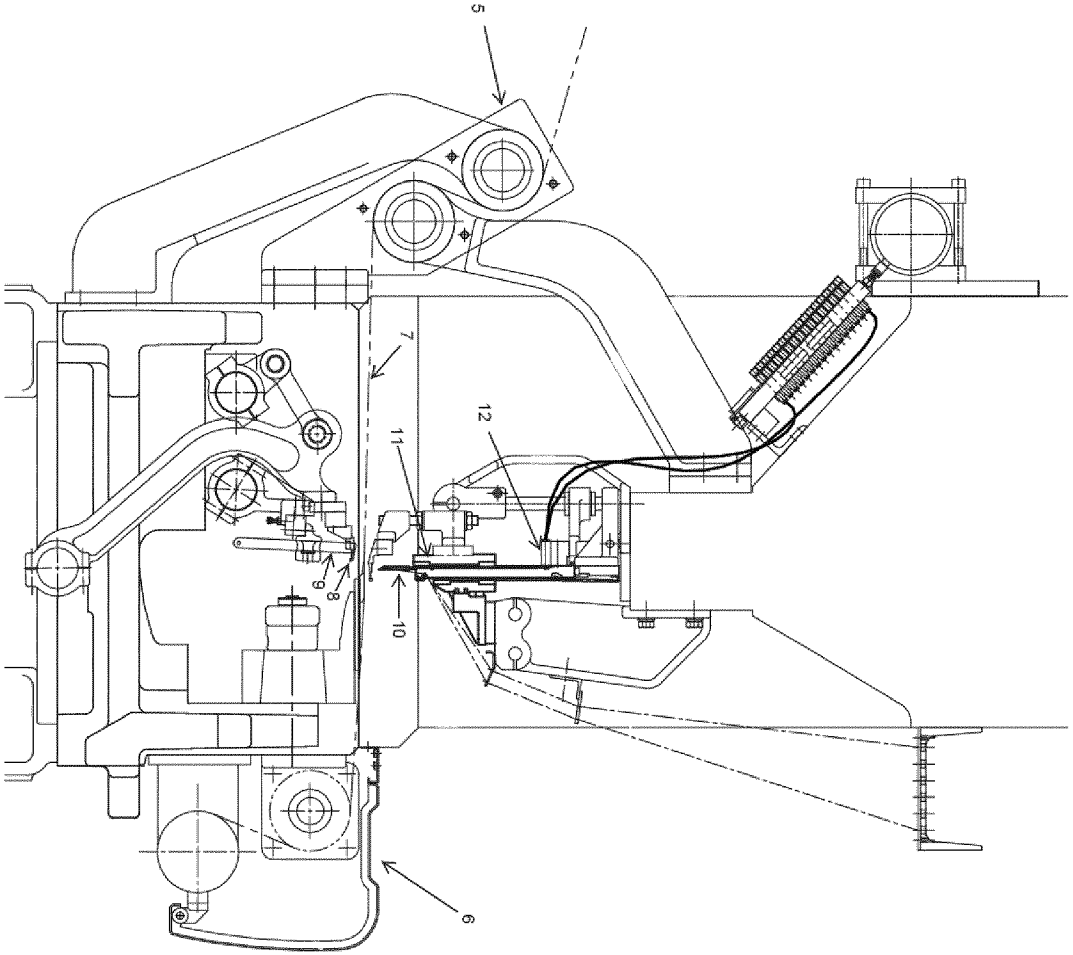
FIG. 5 is an enlarged view of a central portion of FIG. 4.

In particular, it comprises rear 5 and front 6 backing feed mechanisms to feed a backing material 7 through the tufting machine. Beneath the backing material are a series of gauge parts including a series of hooks 8 and knives 9 which are arranged across the tufting machine in a direction perpendicular to the plane of FIGS. 4 and 5. A corresponding number of needles 10 are reciprocated by a needle bar 11 to which they are selectively latched by a latching mechanism 12 as described, for example, in GB2385604. As described to date, the tufting machine is a conventional ICN machine.

In such a machine, the needle bar 11 is reciprocated to form tufts and is moved laterally to selectively align needles with different coloured yarns at a particular position. A controller receives pattern data and, when a needle with the colour demanded by the pattern is in the appropriate position, the latching mechanism 12 will operate to couple that needle 10 to the needle bar 11 such that, as the needle bar reciprocates, the yarn is driven through the backing material 7. The loop of yarn formed by that needle is picked up by the adjacent hook 8 to form a loop of yarn which is then cut by the knife 9 in order to form a cut pile carpet. This is how a conventional ICN machine operates. The machine may also be provided with a looper in place of the hook 8 and with no knife in order to produce a loop pile carpet, although ICN machines are not generally used in this way.

The modifications relate to the manner in which the yarn is fed. In particular, the yarn latch traditionally associated with each needle in an ICN machine has now been eliminated.

Instead, the yarn is fed by an actively driven yarn feed mechanism 2. This comprises a series of servo motors 20 each of which feeds an individual yarn 21 to a respective needle. As shown in FIG. 4, a pair of puller rolls 22 is provided via which the yarns pass in order to equalise the tension in the yarns coming from various different heights as is apparent from FIG. 4. The puller rolls are depicted in broken lines in FIG. 4 to signify that they are considered optional and are, in fact, not used in the preferred embodiment. Instead, the job of controlling the yarn tension is now done by the yarn feed mechanism 2.

In some situations described below, it is necessary to operate the servo motors 20 in reverse. This can create slack yarn between the creel 30 and the yarn feed mechanism 2. If the slack reaches unacceptable levels, a compensation system 31 can be provided between the creel 30 and yarn feed mechanisms 2. This is in the form of a weight for each of the yarns which will effectively hang from the yarn and hence take up any slack if the respective servo motor 20 is driven in reverse.

This will now be described with reference to FIGS. 6 to 11. All of FIGS. 6 to 11 depict two needle strokes starting from top dead center. All of them show the yarn which is fed in order to form a tuft as a dotted line. They also show the yarn which is fed as a backing stitch compensation in the smaller dashed lines. Backing stitch compensation happens in the case of a sliding needle bar where a needle is slid laterally across the machine from one position to another. Under these circumstances, the yarn feed mechanism has to feed additional yarn to the needle in order to compensate for the fact that it has moved, otherwise a needle will pull on the yarn as it is moved thereby increasing the yarn tension. The sum of the yarn feed to form the tuft and the yarn required for the backing stitch compensation represents the total yarn feed fed by each servo motor of the yarn feed controller and is represented by the large dashed line in FIGS. 6 to 11.

Figure 6:
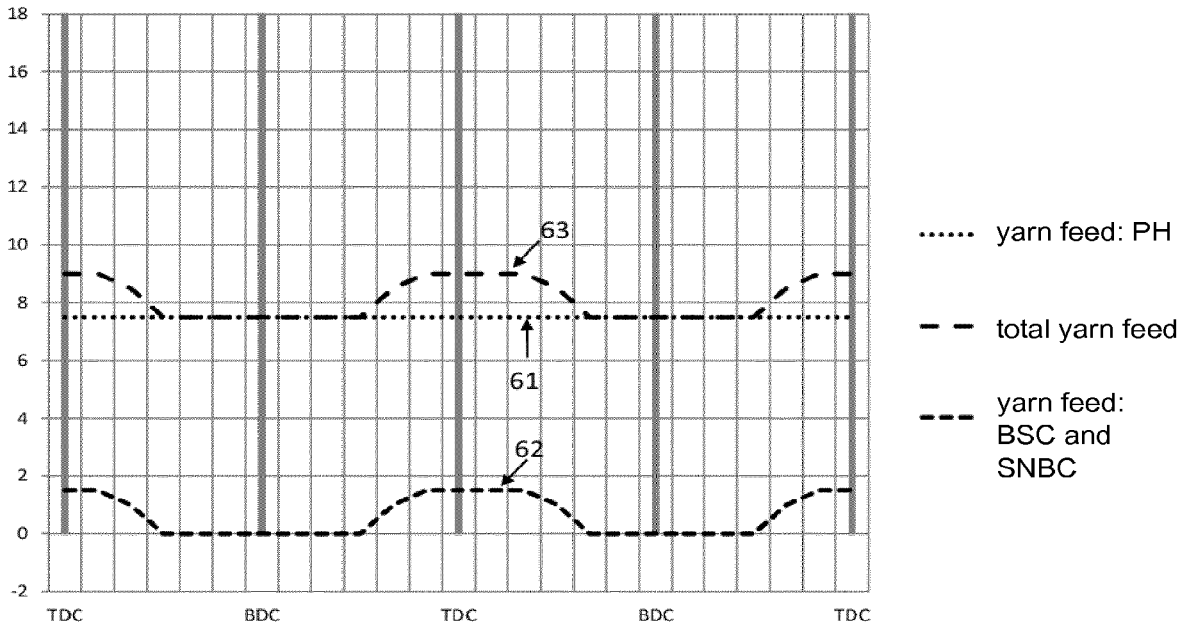
FIG. 6 is a graphical representation of the rate of yarn feed in millimeters through two strokes of a tufting needle in accordance with a conventional yarn feed profile.

FIG. 6 shows the yarn feed profile for a conventional yarn feed mechanism. As can been in FIG. 6, the yarn required to feed the pile height 61 is constant throughout the stroke while a small amount of yarn 62 is fed in the last half of the up-stroke and the first half of the down-stroke as backing stitch compensation. The total yarn feed is shown as 63.

Figure 7:
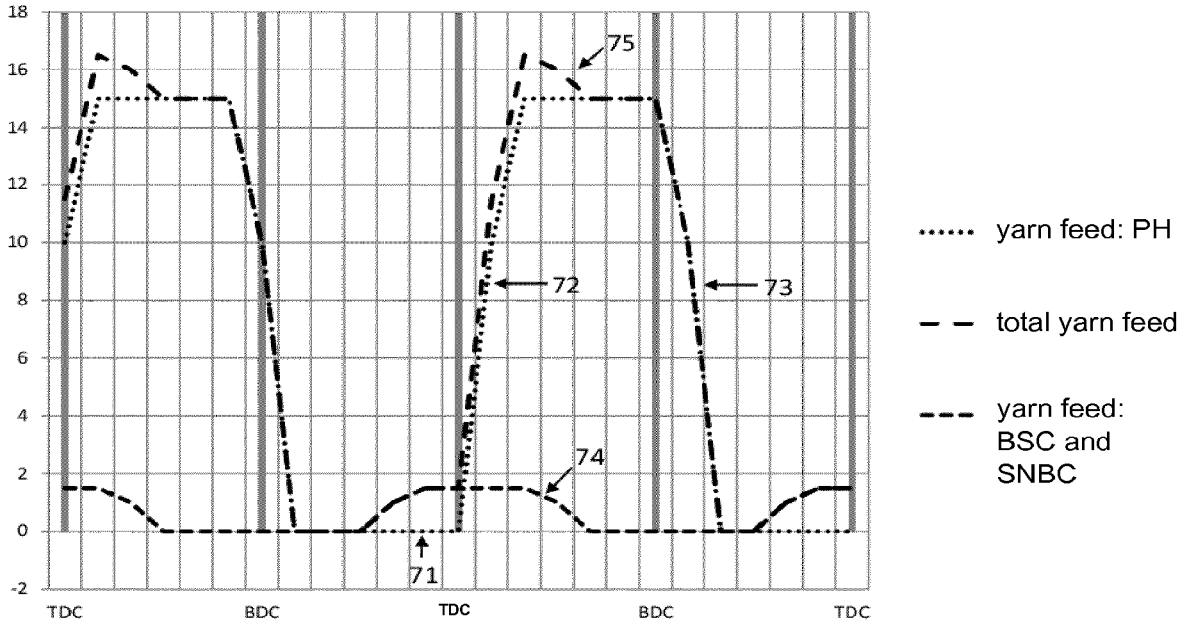
FIG. 7 is a view similar to FIG. 6 according to the present invention for a selected needle.

By complete contrast, in FIG. 7 shows no yarn feed for the tuft is fed for most of the down stroke as depicted by reference numeral 71. However, at top dead center the yarn feed ramps up rapidly as depicted by 72 in order to feed as much yarn as possible by bottom dead center. At bottom dead center, the yarn feed tails off rapidly as depicted by 73 and before the first half of the down-stroke has been completed, the yarn feed for the tuft is stopped entirely. Superimposed on this is the same profile 74 from the the back stitch compensation, providing a total yarn feed 75 which is still dominated by the feeding of the yarn for the tuft in the first half of the stroke. This is done because, all of the yarn required to form a tuft is consumed on the down stroke of the needle and, as the needle undergoes its upstroke, the yarn has to slide through the needle to leave the yarn in place for the tuft.

Figure 8:
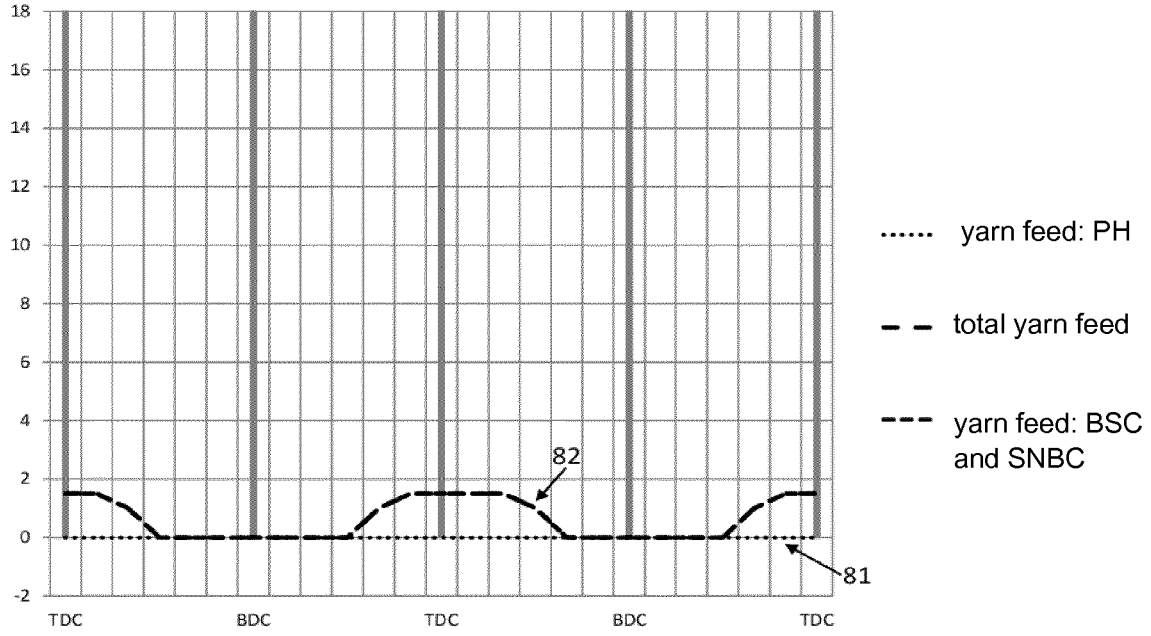
FIG. 8 is a view similar to FIG. 7 showing the yarn feed profile to a non-selected needle.

FIG. 8 shows the situation where a needle is not selected and hence the yarn feed for the tuft 81 remains at zero while the yarn feed for the back stitch compensation 82 is as before and equates to the total yarn feed.

Figure 9:
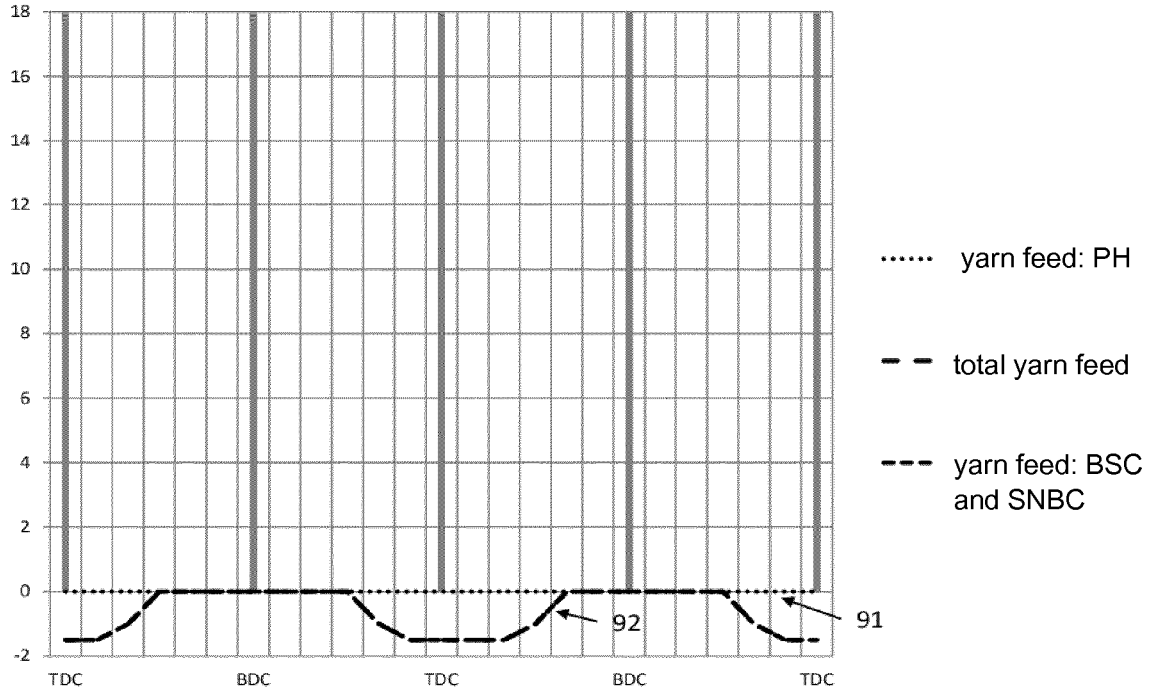
FIG. 9 is a view similar to FIG. 8 showing the yarn feed profile to a non-selecting needle under different circumstances.

FIG. 9 represents a slightly different situation where a needle is not selected such that the yarn required for the tuft 91 remains at zero. If, for a non-selective needle, the distance between a new stitching point and the last stitch is smaller than the distance between the previous stitching point and the last stitch, an excess of yarn will be present and needs to be recovered. In this situation, the backing stitch compensation feed becomes negative 9 indicating that the individual servo motor of the yarn feed system 2 is operating in reverse mode to recover yarn.

Operating in reverse mode can cause slack upstream of the servo motor. As a result of this, a compensation system may be provided upstream of the yarn feed system 2. The compensation system preferably comprises passive elements, for example in the form of small weights which will take up any slack in the yarn.

Figure 10:
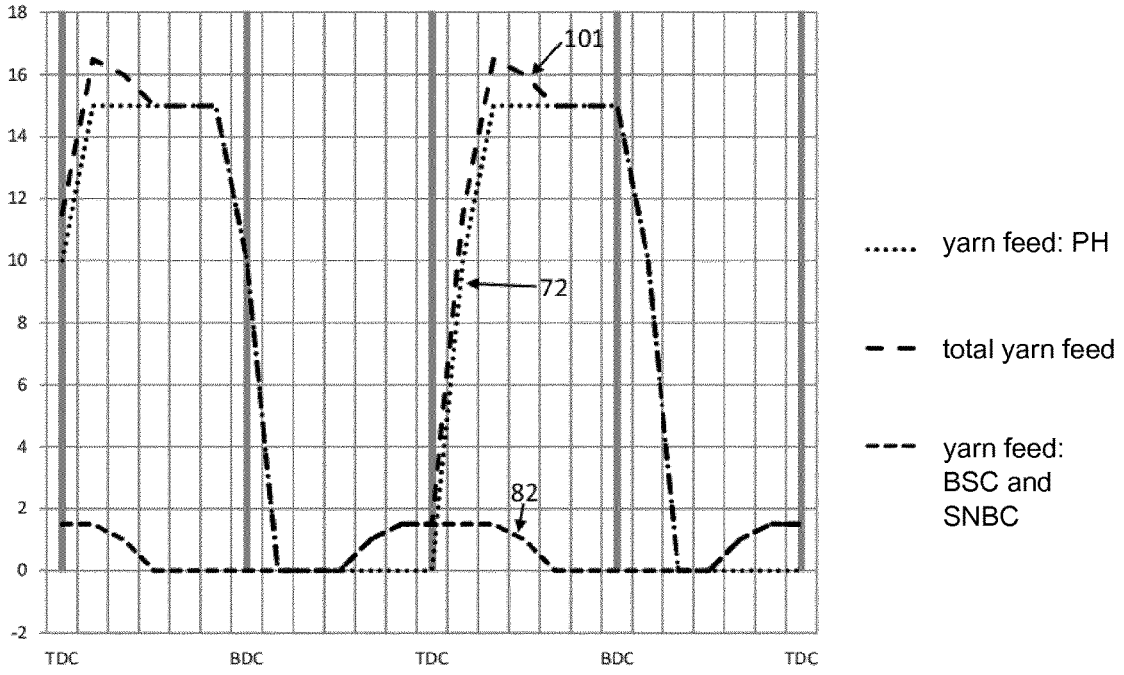
Figure 11:
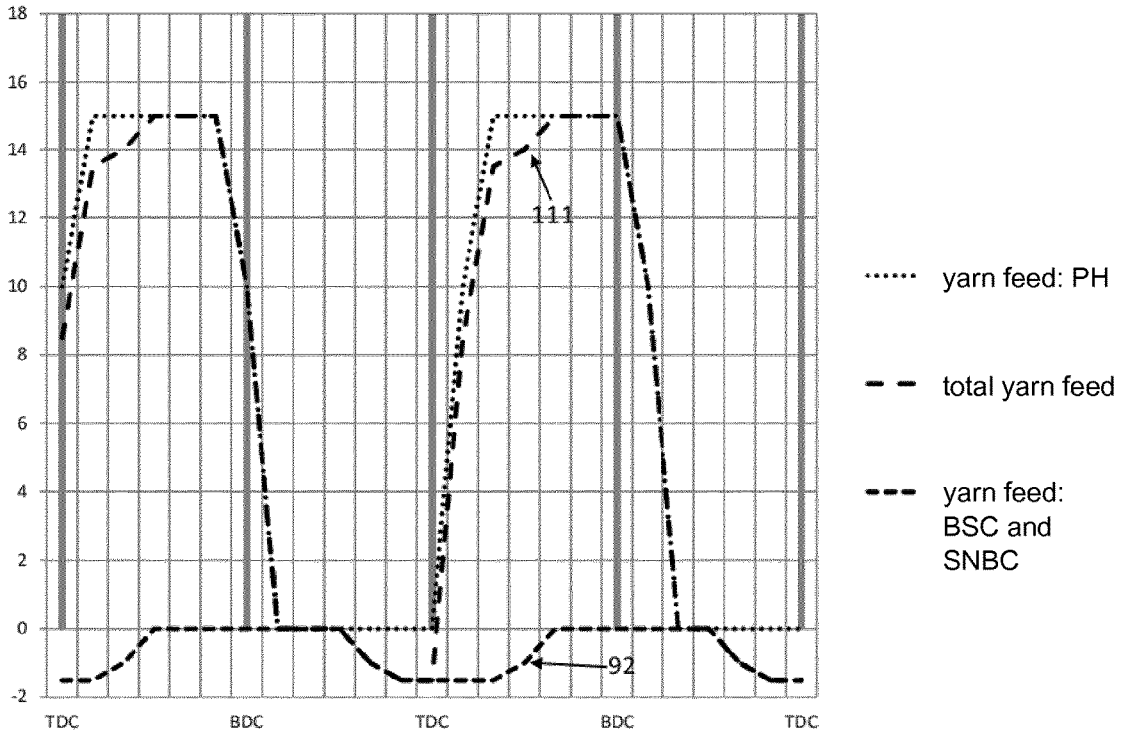

FIGS. 10 and 11 depict the yarn feed to a selected needle either where the needle is reciprocated for the first time or where the needle has not been reciprocated for a number of strokes but still receives the backing stitch compensation.

FIG. 10 effectively corresponds to FIG. 8 in terms of the back stitch compensation 82 with the yarn feed for the tuft 72 from FIG. 7, while FIG. 11 is a combination of the negative yarn feed 92 according FIG. 9 with the yarn feed for the tuft 72 of FIG. 7. FIG. 10 represents the situation where the distance between a new stitching point and the last stitch is greater than the distance between the previous stitching point and the last stitch such that additional yarn 101 is fed while FIG. 11 represents a situation where the distance between a new stitching point (where the needle is not selected) and the last stitch is smaller than the distance between the previous stitching point and the last stitch such that some yarn 111 is held back.

The above yarn feed profiles provides a superposition of the yarn feed needed to compensate for the backing stitch and the yarn feed needed to form the pile height with the desired height. This is done by concentrating the yarn feed in the first half of the cycle as described above. This provides a benefit that the yarn remains more stretched during the entire stitch cycle and slack can be avoided. The yarn feed profile could also advantageously be used in conventional tufting in order to provide better control of the yarn feed.

The invention claimed is:

1. A method for operating a tufting machine, the method comprising:

feeding a backing medium through a tufting region using backing rollers;

reciprocating a needle bar at the tufting region to drive needles into and out of the backing medium, the needle bar comprising at least one row of needles;

receiving loops of yarn on gauge parts on the opposite side of the backing medium;

controlling the operation of the tufting machine using a controller which receives pattern data for a carpet to be tufted;

operating a needle selection mechanism controlled by the controller based on the pattern data by selecting a needle or group of needles with yarn required for the pattern such that the selected needle or group of needles is driven by the needle bar through the backing medium to form a tuft or tufts while a needle or group of needles that is not required for the pattern is not selected by the needle selection mechanism and is not driven through the backing medium as the needle reciprocates; and feeding yarn via a yarn feed mechanism comprising a plurality of actively driven yarn drives each driving a respective yarn to a respective needle, the yarn drives being at a location between a yarn creel and the needle;

wherein the yarn feed mechanism delivers at least 70% of the yarn required for a tuft as the needle moves from top dead center to bottom dead center.

2. The method according to claim 1, further comprising operating the yarn feed mechanism to deliver at least 80% of the yarn required for a tuft as the needle moves from top dead center to bottom dead center.

3. The method according to claim 1, wherein the yarn is fed from the yarn drive to the needle without passing through a latch.

4. The method according to claim 1 wherein the yarn is fed from the yarn drive to the needle without passing through a pair of puller rolls.

5. The method according to claim 1, wherein the yarn is fed from the yarn drive to the needle without passing through any tension regulating or tension influencing components.

6. A tufting machine, the machine comprising;

backing rollers to feed a backing medium through a tufting region;

a needle bar on one side of the backing medium in the tufting region, the needle bar comprising at least one row of needles and being reciprocable at the tufting region to drive needles into and out of backing medium;

gauge parts on the opposite side of the backing medium to receive loops of yarn formed by the needles;

a controller which receives pattern data for a carpet to be tufted;

a needle selection mechanism controlled by the controller based on the pattern data such that a needle or group of needles with yarn required for the pattern is selected by the needle selection mechanism to be driven by the needle bar through the backing medium to form a tuft or tufts while a needle or group of needles that is not required for the pattern is not selected by the needle selection mechanism and is not driven through the backing medium as the needle bar reciprocates;

and a yarn feed mechanism comprising a plurality of actively driven yarn drives each yarn feed drive being configured to drive a respective yarn to a respective needle, the yarn drives being at a location, in use, between a yarn creel and the needle, wherein the yarn feed mechanism is configured to deliver at least 70% of the yarn required for the tuft as the needle moves from top dead center to bottom dead center.

7. The tufting machine according to claim 6, wherein the yarn is arranged to be fed from the yarn drive to the needle without passing through a latch.

8. The tufting machine according to claim 6, wherein the yarn is arranged to be fed from the yarn drive to the needle without passing through a pair of puller rolls.

9. The tufting machine according to claim 6, wherein the yarn is arranged to be fed from the yarn drive to the needle without passing through any tension regulating or tension influencing components.

10. The tufting machine according to any of claim 6, wherein the yarn feed mechanism is configured to deliver at least 80% of the yarn required for the tuft as the needle moves from top dead center to bottom dead center.

11. The tufting machine according to any of claim 6, further comprising a yarn compensation device to take up slack upstream each yarn feed drive.

12. The tufting machine according to claim 11, wherein the yarn compensation device comprises a weight for each yarn which pulls each yarn down to absorb slack.

* * * * *